United States Patent [19]

Gaskell

[11] Patent Number: 4,889,288

[45] Date of Patent: Dec. 26, 1989

[54] FUEL INJECTION NOZZLE

[75] Inventor: David J. Gaskell, Sudbury, Great Britain

[73] Assignee: Lucas Industries Public Ltd. Company, Birmingham, United Kingdom

[21] Appl. No.: 185,833

[22] Filed: Apr. 25, 1988

[30] Foreign Application Priority Data

Apr. 24, 1987 [GB] United Kingdom ..... 8709712

[51] Int. Cl.[4] ..... F02M 45/00; F02M 61/20

[52] U.S. Cl. ..... 239/533.5; 239/533.9

[58] Field of Search ..... 239/533.3–533.12, 239/453

[56] References Cited

U.S. PATENT DOCUMENTS 2,173,814 9/1939 Bischof ..... 239/533.5 X
4,071,197 1/1978 Bailey et al. ..... 239/533.11
4,418,870 12/1983 Mowbray ..... 239/533 B
4,575,008 3/1986 Kaczynski ..... 239/533.3
4,598,867 7/1986 Trachte ..... 239/453

FOREIGN PATENT DOCUMENTS 552873 2/1958 Canada ..... 239/533.5

*Primary Examiner*—Andres Kashnikow
*Assistant Examiner*—Patrick N. Burkhart
*Attorney, Agent, or Firm*—Balogh, Osann, Kramer, Dvorak Genova & Traub

[57] ABSTRACT

A fuel injection nozzle of the inwardly opening type has a valve member which is movable against the action of a spring by fuel under pressure to allow fuel flow through an outlet. The valve member is coupled to a piston which is slidable within a cylinder formed in a part. The cylinder forms a damping chamber from which there is a leakage path and the part is axially adjustable to determine the degree of restriction.

7 Claims, 2 Drawing Sheets

FUEL INJECTION NOZZLE

This invention relates to fuel injection nozzles for supplying fuel to an internal combustion engine the nozzle being of the so-called inwardly opening type and comprising a valve member slidable within a bore in a nozzle body, a seating at one end of the bore, the valve member being shaped for co-operation with the seating to control the flow of fuel through an outlet from an inlet, a nozzle holder to which the nozzle body is secured, a chamber defined in the holder and a coiled compression spring in the chamber, one end of the spring being operatively connected to the valve member to bias the valve member into contact with the seating, the valve member defining an area against which fuel under pressure from the inlet can act to lift the valve member from the seating against the action of the spring.

Examples of injection nozzle of the kind specified are described in the specification of British Application No. 2086473A. The injection nozzles described in the aforesaid specification have provision for damping at least the initial movement of the valve member once the force exerted by the spring has been overcome. The damping arrangements described all make use of the movement of the valve member by arranging for the end of the valve member remote from the seating to form a piston in the bore and restricting the rate at which fuel can escape from the end of the bore. The main disadvantage of the arrangements described is that they are not readily adjusted following assembly of the nozzle and the object of the present invention is to provide a nozzle of the kind specified in which adjustment of the damping action following assembly of the nozzle can be readily effected.

According to the invention a fuel injection nozzle of the kind specified comprises a piston mounted on a part movable with the valve member, a cylinder in which said piston is movable, said cylinder being defined in a member which is adjustable from the end of the holder remote from the nozzle body, the cylinder and piston defining a chamber and a fuel leakage path from said chamber, the degree of restriction of said fuel leakage path being determined by the setting of said member in the holder.

Figure 1:
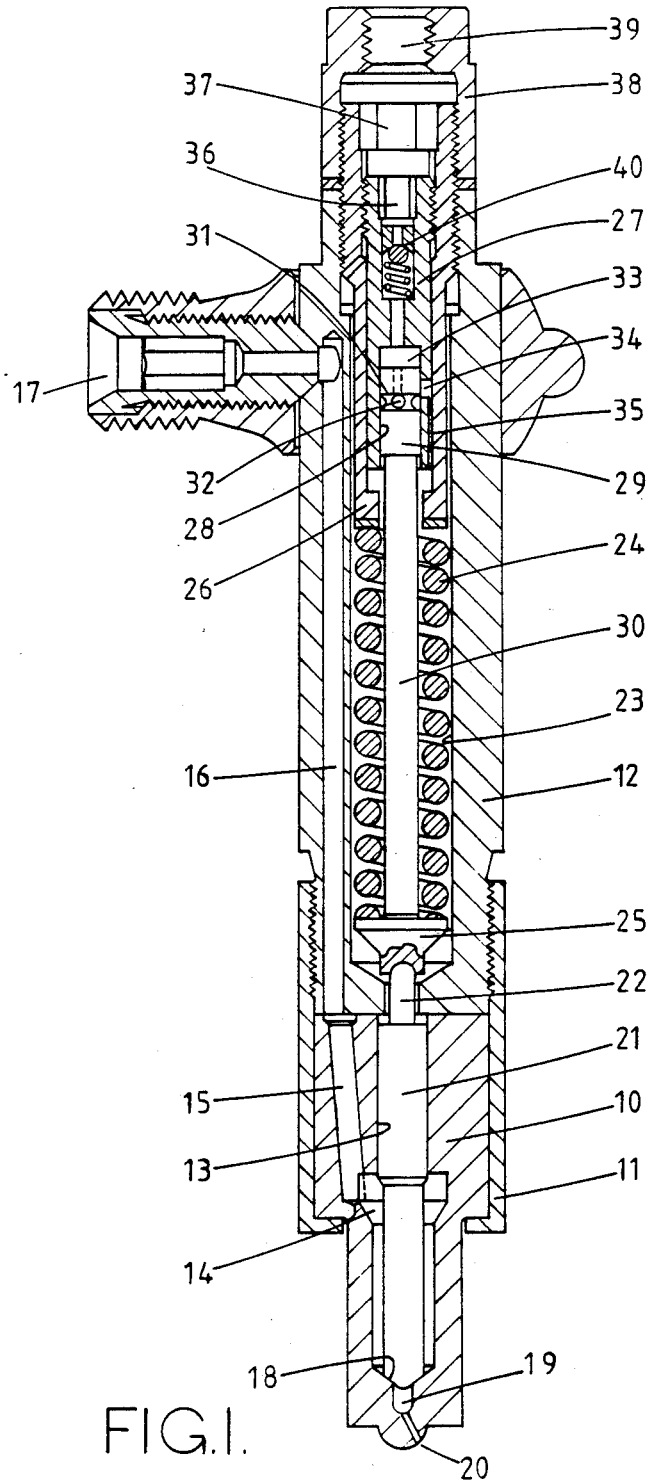
Figure 2:
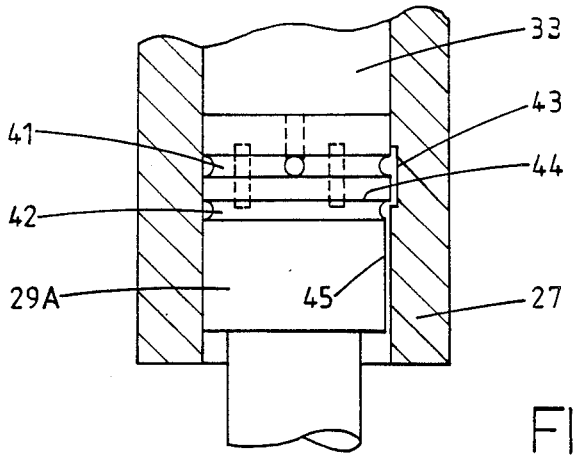
Figure 3:
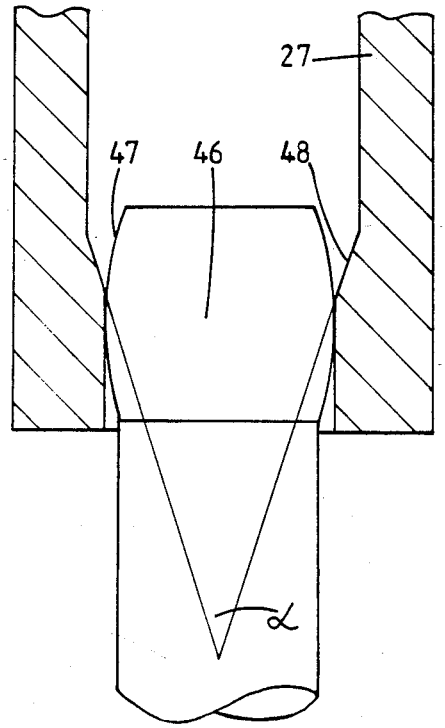
Figure 4:
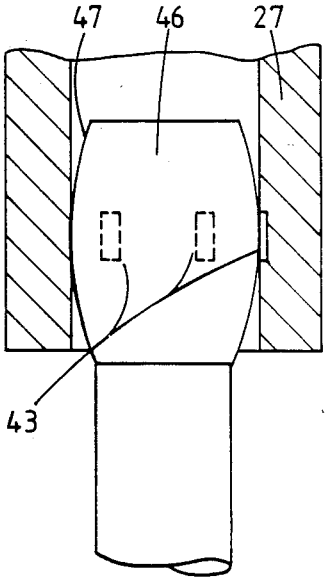

In the accompanying drawings:

FIG. 1 is a sectional side elevation of one example of a fuel injection nozzle in accordance with the invention, and FIGS. 2, 3 and 4 show to an enlarged scale modifications to part of the nozzle seen in FIG. 1.

Referring to FIG. 1 of the drawings, the injector comprises a nozzle body 10 of stepped cylindrical form and which is secured by means of a cap nut 11, to one end of a cylindrical elongated nozzle holder 12. The nozzle body is formed with a stepped bore 13 in which is defined an enlargement 14 which is connected by way of passages 15 and 16 formed in the nozzle body and the holder respectively with a fuel inlet 17. A seating 18 is defined at the end of the bore 13 remote from the holder and downstream of the seating is a "sac" volume 19 from which extends an outlet orifice 20. Slidable in the bore 13 is a valve member 21 which is shaped for co-operation with the seating, the valve member defining an area which is exposed to the fuel pressure in the enlargement. The extent of movement of the valve member is limited by its abutment with the end face of the holder, the valve member being provided with a reduced portion 22 which extends through an aperture in the holder into an elongated chamber 23 defined in the holder. Mounted within the chamber is a coiled compression spring 24 which at one end engages a spring abutment 25 which bears against the extension 22 of the valve member. At its opposite end the spring abuts against a cup-shaped spring abutment 26 which is mounted in screw thread engagement with the wall of the chamber.

Mounted within the spring abutment 26 is a cylindrical member 27 the end portion of which remote from the nozzle body, is provided with a peripheral screw thread for engagement with a complementary thread formed on the internal peripheral surface of the abutment 26. Extending from the end of the member 27 nearer to the spring, is a cylinder 28 within which is located a piston 29 which is mounted at the end of a rod 30 which conveniently is formed integrally with the spring abutment 25.

Formed on the periphery of the piston is a groove 31 which by way of a port 32 and an axial drilling in the piston, communicates with a damping chamber 33 defined by the cylinder and the piston.

Formed in the wall of the cylinder is a port 34 and the port communicates by way of a flat 35 formed on the member 27, with the chamber formed in the holder and which accommodates the spring. In the closed position of the valve member as shown, the groove 31 is just exposed to the port 34 and in operation when fuel under pressure is supplied to the inlet 17, and when the fuel pressure attains a sufficiently high volume, the valve member will be lifted upwardly from the seating against the action of the spring to permit flow of fuel through the outlet 20. The movement of the valve member imparts movement to the piston 29 and the fuel which is contained in the damping chamber 33 is compressed but can only escape at a limited rate through a leakage path defined by the port 34 and the flat 35. The movement of the valve member is therefore damped and by appropriate shaping of the port 34, the degree of restriction and therefore the degree of damping can be made to vary with the movement of the valve member. Moreover, by axial adjustment of the member 27, the overall damping action imposed upon the valve member can be adjusted. For example, if the member is moved outwardly away from the spring, the degree of damping will be increased and vice versa. A hexagonal profile 36 is provided on the member 27 to permit its adjustment relative to the abutment 26 and the latter is provided with a similar profile 37 to permit its adjustment relative to the holder, this adjustment having the effect of varying the nozzle opening pressure. The spring abutment 26 is locked in position by means of a cap 38 which defines an outlet 39 for a connection to a drain and the chamber which contains the spring communicates with the outlet 39.

Since it is not required that the closing movement of the valve member should be damped, the chamber 33 is connected by way of a non-return valve 40 to the space within the cap 38 and the valve will lift during the closing movement of the valve member to permit fuel flow into the chamber 33 at a substantially unrestricted rate.

FIG. 2 shows a modified form of piston 29A in which the piston is provided with a pair of axially spaced grooves 41, 42, the groove 41 being in constant communication with th damping chamber 33 by way of an axial drilling in the piston. The groove 41 is in constant communication with a plurality of short axial shallow grooves 43 formed in the wall of the cylinder and the groove 42 forms a control edge 44 which determines the degree of restriction to fuel flow between the grooves 43 and flats 45 formed on the piston. As in the example of FIG. 1 the degree of restriction and hence the damping effect achieved depends upon the axial setting of the member 27, the degree of restriction reducing as the valve member moves away from the seating.

In the example shown in FIGS. 3 and 4 the piston 46 has a convex surface 47 and in the example of FIG. 3 the wall of the cylinder defines a tapered section 48 which opens outwardly from the open end of the cylinder. As a result the damping effect produced diminishes as the piston is moved into the cylinder.

In the example of FIG. 4 the grooves 43 of the example of FIG. 2 are employed and the degree of restriction will depend upon the axial setting of the member 27, the piston 46 being shown in the position which it adopts when the valve member is fully open.

In each of the examples described it may be desirable for the respective port or grooves to be closed when the valve member is in the closed position in view of the fact that the initial movement of the valve member will result in compression of the fuel in the chamber 33 and elastic straining of the wall of the chamber.

I claim:

1. A fuel injection nozzle for supplying fuel to an internal combustion engine comprising a valve member slidable in a bore in a nozzle body, a seating at one end of the bore, said valve member being shaped for cooperation with said seating to control the flow of fuel through an outlet, a nozzle holder to which said body is secured, a chamber defined in said holder and a coiled compression spring in said chamber, one end of said spring being operatively connected to said valve member to bias said valve member into contact with said seating, said valve member defining an area against which fuel under pressure from an inlet can act to lift said valve member away from said seating against the action of said spring, characterized by a piston mounted on a part movable with said valve member, a groove defined in the wall of said piston, a port in the wall of said piston and a flat formed on the exterior surface of said piston, said flat connecting said port with said chamber containing said spring, a cylinder in which said piston is movable, said cylinder being defined in a member which is adjustable from the end of said holder remote from said nozzle body, said cylinder and piston defining a damping chamber and a fuel leakage path communicating said groove with said damping chamber, the degree of restriction of said leakage path being determined by the setting of said member in said holder.

2. A fuel injection nozzle according to claim 1 characterized by a non-return valve, through which fuel can flow into said damping chamber during movement of said valve member towards said seating.

3. A fuel injection nozzle for supplying fuel to an internal combustion engine comprising a valve member slidable in a bore in a nozzle body, a seating at one end of the bore, said valve member being shaped for cooperation with said seating to control the flow of fuel through an outlet, a nozzle holder to which said body is secured, a chamber defined in said holder and a coiled compression spring in said chamber, one end of said spring being operatively connected to said valve member to bias said valve member into contact with said seating, said valve member defining an area against which fuel under pressure from an inlet can act to lift said valve member away from said seating against the action of said spring, characterized by a spherical piston mounted on a part movable with said valve member, a cylinder in which said piston is movable, said cylinder being defined in a member which is adjustable from the end of said holder remote from said nozzle body, said cylinder and piston defining a damping chamber and a fuel leakage path from said damping chamber, the degree of restriction of said leakage path being determined by the setting of said member in said holder, and a non-return valve, through which fuel can flow into said damping chamber during movement of said valve member towards said seating.

4. A fuel injection nozzle for supplying fuel to an internal combustion engine comprising a valve member slidable in a bore in a nozzle body, a seating at one end of the bore, said valve member being shaped for cooperation with said seating to control the flow of fuel through an outlet, a nozzle holder to which said body is secured, a chamber defined in said holder and a coiled compression spring in said chamber, one end of said spring being operatively connected to said valve member to bias said valve member into contact with said seating, said valve member defining an area against which fuel under pressure from an inlet can act to lift said valve member away from said seating against the action of said spring, characterized by a spherical piston mounted on a part movable with said valve member, a cylinder in which said piston is movable, said cylinder being defined in a member which is adjustable from the end of said holder remote from said nozzle body, said cylinder and piston defining a damping chamber and a fuel leakage path from said damping chamber, the degree of restriction of said leakage path being determined by the setting of said member in said holder, said cylinder defining a tapered section which opens outwardly from the open end of said cylinder.

5. A fuel injection nozzle for supplying fuel to an internal combustion engine comprising a valve member slidable in a bore in a nozzle body, a seating at one end of the bore, said valve member being shaped for cooperation with said seating to control the flow of fuel through an outlet, a nozzle holder to which said body is secured, a chamber defined in said holder and a coiled compression spring in said chamber, one end of said spring being operatively connected to said valve member to bias said valve member into contact with said seating, said valve member defining an area against which fuel under pressure from an inlet can act to lift said valve member away from said seating against the action of said spring, characterized by a spherical piston mounted on a part movable with said valve member, a cylinder in which said piston is movable, said cylinder being defined in a member which is adjustable from the end of said holder remote from said nozzle body, said cylinder and piston defining a damping chamber and a fuel leakage path from said damping chamber, the degree of restriction of said leakage path being determined by the setting of said member in said holder, said cylinder defining a shallow axial groove, positioned to connect said damping chamber with said chamber containing the spring as said valve member is moved away from said seating.

6. A fuel injection nozzle for supplying fuel to an internal combustion engine comprising a valve member slidable in a bore in a nozzle body, a seating at one end of the bore, said valve member being shaped for co-operation with said seating to control the flow of fuel through an outlet, a nozzle holder to which said body is secured, a chamber defined in said holder and a coiled compression spring in said chamber, one end of said spring being operatively connected to said valve member to bias said valve member into contact with said seating, said valve member defining an area against which fuel under pressure from an inlet can act to lift said valve member away from said seating against the action of said spring, characterized by a piston defining a pair of axially spaced circumferential grooves, said piston mounted on a part movable with said valve member, a cylinder in which said piston is movable, a shallow axial groove formed in the wall of said cylinder, said axial groove providing variable communication between said circumferential grooves as said valve member is lifted from said setting, said cylinder being defined in a member which is adjustable from the end of said holder remote from said nozzle body, said cylinder and piston defining a damping chamber and a passage means connecting said grooves with said damping chamber, the degree of restriction of said passage means being determined by the setting of said member in said holder.

7. A fuel injection nozzle according to claim 6 characterized by a non-return valve, through which fuel can flow into said damping chamber during movement of said valve member towards said seating.

* * * * *